US006102511A

United States Patent [19]

Shioya et al.

[11] Patent Number: 6,102,511

[45] Date of Patent: Aug. 15, 2000

[54] INK JET RECORDING APPARATUS AND METHOD FOR CONTROLLING AN AMOUNT OF INK DISCHARGED AFTER AN INTERRUPTION IN RECORDING

[75] Inventors: Makoto Shioya, Tokyo; Yutaka Kurabayashi, Tokorozawa; Shinya Mishina; Shin-ichi Sato, both of Kawasaki; Katsuhiko Takahashi, Yokohama; Masashi Ogasawara, Kawasaki, all of Japan

[73] Assignee: Canon Kabushiki Kaisha, Tokyo, Japan

[21] Appl. No.: 09/037,997

[22] Filed: Mar. 11, 1998

[30] Foreign Application Priority Data

Mar. 14, 1997 [JP] Japan ..... 9-061067
Feb. 20, 1998 [JP] Japan ..... 10-038825

[51] Int. Cl.[7] ..... B41J 29/38

[52] U.S. Cl. ..... 347/9; 347/14

[58] Field of Search ..... 349/5, 9, 14, 19

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/56 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,574,886 | 11/1996 | Koike et al. | 347/5 |
| 5,610,637 | 3/1997 | Sekiya et al. | 347/10 |
| 5,896,142 | 4/1999 | Yamanaka | 347/14 |
| 5,927,874 | 7/1999 | Kikuta et al. | 347/5 |

FOREIGN PATENT DOCUMENTS

| | | |
|---|---|---|
| 0481625 | 4/1992 | European Pat. Off. . |
| 0679011 | 10/1995 | European Pat. Off. . |
| 719647 | 7/1996 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—John Barlow
*Assistant Examiner*—Juanita Stephens
*Attorney, Agent, or Firm*—Fitzpatrick, Cella, Harper & Scinto

[57] ABSTRACT

An ink jet recording method and apparatus for performing recording by discharging ink onto a recording medium in accordance with recording data using a recording head having ink discharge ports for discharging the ink. The apparatus includes a scanning unit for scanning the recording head relative to the recording medium for discharging ink to record pixels on the recording medium, and a determining unit for determining whether the recording data includes non-discharge data for a predetermined number of successive pixels to be recorded by the recording head, and for generating a corresponding determination output signal. The apparatus further includes a control unit for controlling ink discharge in accordance with the determination output signal such that an amount of ink discharged for forming at least one pixel subsequent to the predetermined number of successive pixels is reduced from a predetermined recording amount, when the recording data is determined to include non-discharge data for the predetermined number of successive pixels.

46 Claims, 6 Drawing Sheets

FIG. 3A

| | | | | | | | | | |
|---|---|---|---|---|---|---|---|---|---|
| 2 | 0 | 0 | 0 | 0 | 2 | 2 | 2 | 2 | IMAGE TO BE RECORDED |
| 2 | 0 | 0 | 0 | 0 | 2 | 2 | 2 | 2 | ACTUALLY RECORDED IMAGE |

→ MAIN SCANNING DIRECTION

0 : PIXEL NOT DISCHARGED
2 : PIXEL TO BE DISCHARGED

FIG. 3B

| | | | | | | | | | |
|---|---|---|---|---|---|---|---|---|---|
| 0.....0 | 0 | 0 | 0 | 0 | 2 | 2 | 2 | 2 | IMAGE TO BE RECORDED |
| 0.....0 | 0 | 0 | 0 | 0 | 1 | 2 | 2 | 2 | ACTUALLY RECORDED IMAGE |

→ MAIN SCANNING DIRECTION

INK JET RECORDING APPARATUS AND METHOD FOR CONTROLLING AN AMOUNT OF INK DISCHARGED AFTER AN INTERRUPTION IN RECORDING

BACKGROUND OF THE INVENTION

1. Field of the Invention

The present invention relates to an ink jet recording apparatus and to an ink jet recording method for recording an image. More specifically, the present invention relates to an on-demand type ink jet recording apparatus using an on-demand type ink jet recording method of forming one pixel having a plurality of ink droplets.

2. Description of the Related Art

Recently, as information processing systems using personal computers and the like have come into wide use, image information handled thereby is diversified. From this point of view, recording apparatuses for outputting the image information from the information processing systems are required to make various types of output. So-called high definition recording is one of the various types of output.

When the high definition recording is effected by ink jet recording systems, it is customary to employ a method of discharging or ejecting ink droplets as fine liquid droplets.

However, an increase of ink density due to the evaporation of volatile components contained in the ink is a relatively important problem with apparatuses which record by discharging fine ink droplets.

More specifically, on-demand type ink jet recording heads which are used by almost all of the ink jet recording apparatuses have discharge ports from which ink is not always continuously discharged. When ink is not continuously discharged, the density of coloring material within the ink may be increased in the vicinity of the ink discharge ports from which no ink was recently discharged because volatile components, such as water and the like, in the ink are evaporated from the ink discharge ports. When discharge of the ink is resumed, almost all of the small droplets of the ink have a relatively high concentration of color material, and a dot made of the ink droplets has a color density higher than that of other dots. In this case, it is possible that the portion of a recording image where the discharge of the ink is resumed as described above, or the portion to which discharge of the ink is newly started (hereinafter, referred to as a writing start position), has a relatively high color density.

This problem is particularly noticeable in recording systems such as the so-called multi-pass system and the multi-scan system in which one line in a main scanning direction is formed by being scanned a plurality of times. The problem occurs because if a plurality of different discharge ports record onto one line, ink droplets which were condensed at the respective discharge ports while the discharge of the ink therefrom was earlier presented are discharged to the same writing start position during a plurality of scans. As a result, the density of the image at the writing start position is relatively high and conspicuous.

SUMMARY OF THE INVENTION

An object of the present invention is to provide an ink jet recording apparatus and an ink jet recording method capable of recording a high quality image by suppressing an increase of color density at a writing start position.

According to a first aspect of the present invention, an ink jet recording apparatus is provided for performing recording by discharging ink onto a recording medium in accordance with recording data using a recording head having ink discharge ports for discharging the ink. The apparatus includes scanning means for scanning the recording head relative to the recording medium for discharging ink to record pixels on the recording medium, and determining means for determining whether the recording data includes non-discharge data for a predetermined number of successive pixels to be recorded by the recording head, and for generating a corresponding determination output signal. The apparatus further includes control means for controlling ink discharge in accordance with the determination output signal such that an amount of ink discharged for forming at least one pixel subsequent to the predetermined number of successive pixels is reduced from a predetermined recording amount, when the recording data is determined to include non-discharge data for predetermined number of successive pixels.

According to another aspect of the present invention, an ink jet recording apparatus is provided for performing recording by discharging ink onto a recording medium in accordance with recording data using a recording head having ink discharge ports for discharging the ink. The apparatus includes scanning means for scanning the recording head relative to the recording medium for discharging ink to record pixels, and determining means for determining whether the ink is not discharged for a predetermined period of time, in a non-recording period, in accordance with the recording data, and for generating a corresponding determination output signal. The apparatus further includes control means for controlling ink discharge in accordance with the determination output signal such that an amount of ink discharged during a discharge period to record at least one pixel, subsequent to the non-recording period, is reduced from a predetermined recording amount, when the determining means determines that the ink is not discharged during the non-recording period.

According to yet another aspect of the present invention, an ink jet recording apparatus is provided for performing recording by discharging ink onto a recording medium in accordance with recording data using a recording head having ink discharge ports for discharging the ink. The apparatus includes scanning means for scanning the recording head relative to the recording medium for discharging ink to record pixels, and determining means for determining when a non-discharge section of recording data, corresponding to a predetermined time period, changes to a discharge section of recording data, and for generating a corresponding determination output signal. The apparatus further includes control means for controlling recording in accordance with the determination output signal such that an amount of ink discharged to record at least one pixel, when the non-discharge section is determined to change to the discharge section, is reduced from a predetermined recording amount.

According to another aspect of the present invention, an ink jet recording method is provided for performing recording by discharging ink onto a recording medium in accordance with recording data using a recording head having ink discharge ports for discharging the ink. The method includes the steps of scanning the recording head relative to the recording medium and discharging ink to record pixels on the recording medium, and determining whether the recording data includes non-discharge data for a predetermined number of successive pixels to be recorded by the recording head, and generating a corresponding determination output signal. The method further includes the step of controlling ink discharge in accordance with the determination output signal such that an amount of ink discharged for forming at least one pixel subsequent to the predetermined number of successive pixels is reduced from a predetermined recording amount, when the recording data is determined to include non-discharge data for the predetermined number of successive pixels.

According to yet another aspect of the present invention, an ink jet recording method is provided for performing recording by discharging ink onto a recording medium in accordance with recording data using a recording head having ink discharge ports for discharging the ink. The method includes the steps of scanning the recording head relative to the recording medium and discharging ink to record pixels, and determining whether the ink is not discharged for a predetermined period of time, in a non-recording period, in accordance with the recording data, and generating a corresponding determination output signal. The method further includes the step of controlling ink discharge in accordance with the determination output signal such that an amount of ink discharged during a discharge period to record at least one pixel, subsequent to the non-recording period, is reduced from a predetermined recording amount, when the ink is determined not to be discharged during the non-recording period.

According to still another aspect of the present invention, an ink jet recording method is provided for performing recording by discharging ink onto a recording medium in accordance with recording data using a recording head having ink discharge ports for discharging the ink. The method includes the steps of scanning the recording head relative to the recording medium and discharging ink to record pixels, and determining when a non-discharge section of recording data, corresponding to a predetermined time period, changes to a discharge section of recording data, and generating a corresponding determination output signal. The method further includes the step of controlling recording in accordance with the determination output signal such that an amount of ink discharged to record at least one pixel, when the non-discharge section is determined to change to the discharge section, is reduced from a predetermined recording amount.

BRIEF DESCRIPTION OF THE DRAWINGS

FIG. 3A and FIG. 3B show a recording method according to the first embodiment of the present invention;

DESCRIPTION OF THE PREFERRED EMBODIMENT

Embodiments of the present invention will be described below in detail with reference to the drawings.

Embodiment 1

As a general rule, the recording method of the first embodiment controls recording such that when one pixel is formed of two ink droplets and a short rest period longer than a predetermined time period occurs before the start of discharge of the ink, a pixel which is recorded at the start of discharge of the ink is formed of one droplet. This is based on the knowledge that when the rest period is longer than the predetermined time period, the density of a color material in the ink is increased by the evaporation of water.

Figure 1:
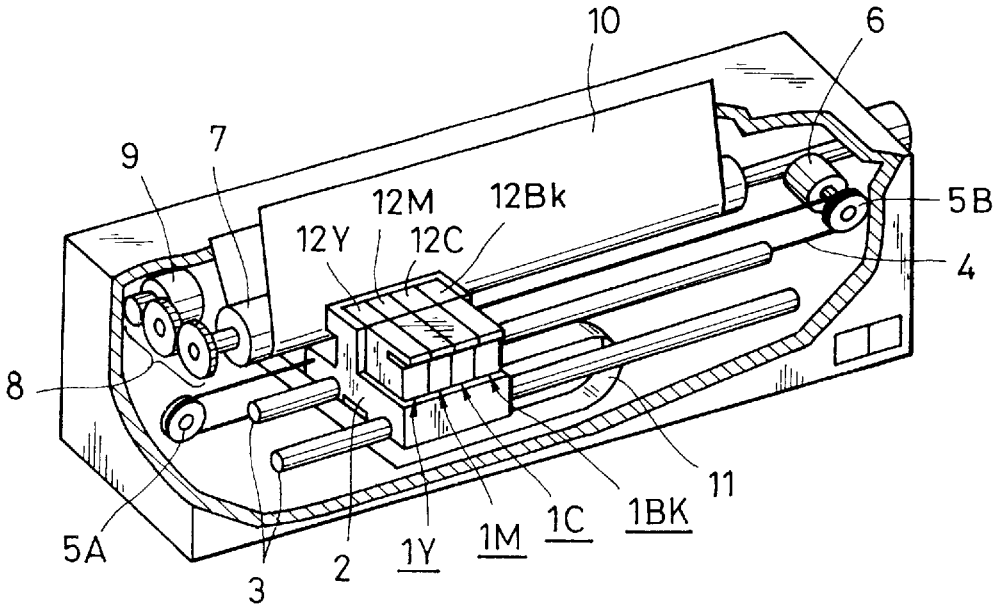
FIG. 1 is a perspective view showing an arrangement of an ink jet recording apparatus according to a first embodiment of the present invention.

FIG. 1 is a perspective view showing the main portion of an ink jet recording apparatus according to the first embodiment.

In FIG. 1, ink jet units 1Y, 1M, 1C, 1B*k* are mounted on a carriage 2 and comprise heads 12Y, 12M, 12C, 12B*k* for discharging yellow (Y), magenta (M), cyan (C) and black (Bk), respectively, and tanks for storing inks of the respective colors.

Each head is provided with, for example, 32 discharge ports which are disposed at intervals of 62.5 micrometers in the feed direction (hereinafter, also referred to as an auxiliary scanning direction) of a recording medium such as a sheet 10. A heater is provided with an ink passage communicating with the respective discharge ports to generate thermal energy used to discharge the ink. The heater generates heat in accordance with an electric pulse controlled in according with drive data. With this arrangement, film boiling is caused in the ink and ink droplets are discharged from the discharge ports as bubbles are created by the film boiling.

The carriage 2 has the heads 12Y, 12M, 12C, 12B*k* and the tanks detachably mounted thereon, and moves while being guided by two guide shafts 3 slidingly engaged with a portion thereof. The carriage 2 is moved by, for example, a belt 4 which is stretched around pulleys 5A, 5B and which is moved by the driving force of a motor 6 through the pulleys. A flexible cable 11 is electrically connected to the respective heads and permits a discharge signal and a control signal corresponding to print data to be transmitted from the controller of the apparatus to a head drive circuit (head driver) provided with each head at a portion thereof.

A platen roller 7 extends in the lengthwise direction, parallel with the guide shafts 3, and feeds the recording sheet 10 when rotated by a sheet feed motor 9. Platen roller 7 also regulates the recording surface of the recording sheet 10. With the above arrangement, the heads of the respective ink jet units can execute printing by discharging inks onto the print surface of the recording sheet 10, which confronts the discharge ports as the carriage 2 moves across recording sheet 10.

Figure 2:
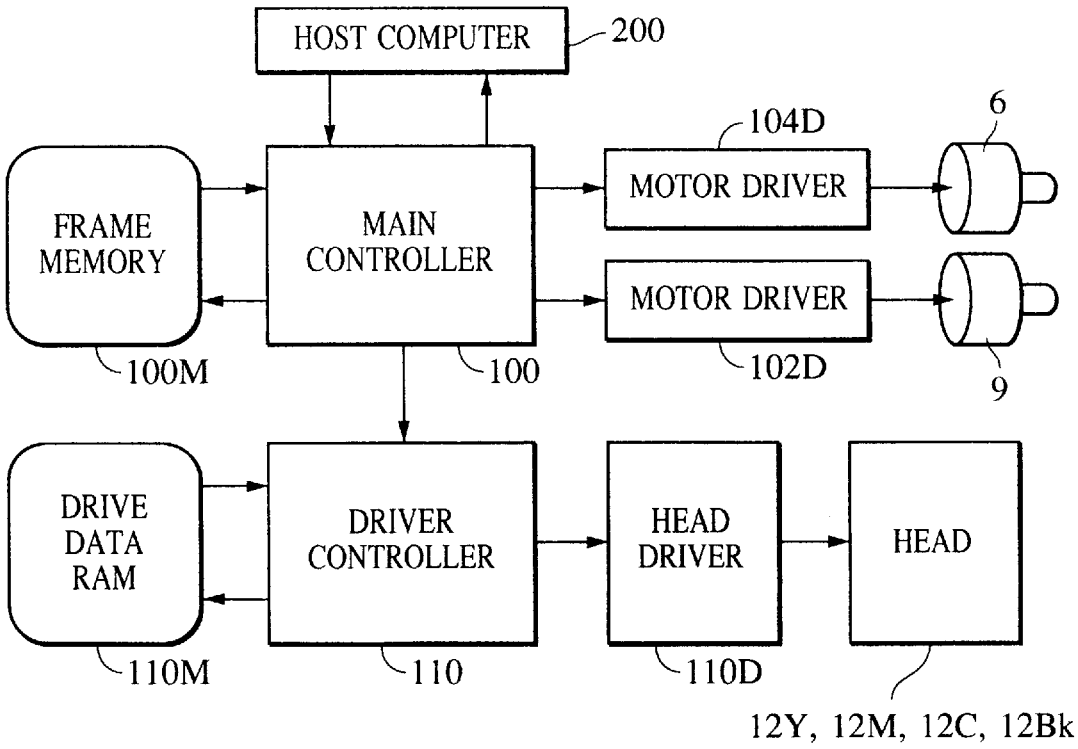
FIG. 2 is a block diagram showing an arrangement for controlling the ink jet recording apparatus shown in FIG. 1.

FIG. 2 is a block diagram showing an arrangement for controlling the ink jet recording apparatus shown in FIG. 1.

A main controller 100 comprises a CPU and the like, converts image data supplied from a host computer 200 into pixel data to which gradation data is attached and stores it in a frame memory 100M. In addition, the main controller 100 supplies the gradation data of each pixel stored in the frame memory 100M to a driver controller 110 at a specific timing.

The driver controller 110 converts the supplied gradation data into discharge data (data showing ON/OFF states of the heater in each head 12Y, 12M, 12C and 12B*k* which corresponds to a discharge port number (which indicates the particular number of a discharge port in the row of discharge ports of the recording head 12Y, 12M, 12C and 12B*k* and a scan number (which indicates the particular number of the scan in the main-scan direction) and stores it in a drive data RAM 110M. The driver controller 110 reads out drive data stored in the drive data RAM 110M in accordance with a discharge port number and a scan number provided with the control signal from the main controller 100. The drive controller 110 then supplies the drive data to a head driver 110D as well as controls a timing at which it is driven.

In the above arrangement, the main controller 100 controls the discharge of the respective color inks effected by the heads 12Y, 12M, 12C, 12B*k*, the rotation of the carriage motor 6 and the rotation of the sheet feed motor 9 through the driver controller 110, a motor driver 104D and a motor driver 102D, respectively. With this operation, a character, or an image, are printed on the recording sheet 10 in accordance with the image data.

Although the driver controller 110 converts the gradation data into the discharge data in the aforesaid arrangement, it may be converted by the main controller 100. In this case, since the discharge data can be stored in the frame memory 100M, the RAM 110M can be omitted. The black ink comprises about 3% of C. I. Food Black 2, about 15% of diethylene glycol, about 10% of thiodiglycol and the rest is primarily water. The cyan ink comprises about 3% of C. I. Direct Blue 199, the magenta ink comprises about 2.5% of C. I. Acid Red 289 and the yellow ink comprises about 2% of C. I Direct Yellow 86 and the solvent of these inks are the same as that of the black ink.

FIG. 3A and FIG. 3B show an example of the recording method of the first embodiment. The first embodiment essentially carries out two-level recording in which respective pixels include 0 to 2 ink droplets. This is carried out in, for example, a case such that a character and an image are recorded using only black ink by an apparatus using a recording head capable of executing so-called multi-droplet recording in which fine ink droplets can be discharged. In FIGS. 3A and 3B, the respective pixels of an image to be recorded are shown by the number of ink droplets to be discharged. More specifically, "0", "1" and "2" in the drawings show the number of ink droplets which are discharged to one pixel. Further, each pixel in the drawings is shown in a pixel train for one line corresponding to one discharge port.

The image (data) to be recorded as shown in FIG. 3A shows relatively few successive pixels to which no ink is discharged. In this case, since a smaller amount of water is evaporated through a discharge port, and the density of a color material such as dye does not increase, the image to be recorded is recorded without reducing the amount of discharged ink.

On the contrary, the example shown in FIG. 3B shows a relatively large number of successive pixels to which no ink is discharged. Since it is possible that the density of the color material is increased by the evaporation of water in the vicinity of the discharge port, the number of ink droplets for forming one pixel at a writing start position is decreased and the pixel is recorded by one ink droplet as shown in the drawings. This operation prevents an increase of the color density of the pixel which contains the ink in which the color material has a relatively high density, whereby an image density can be made uniform as compared to a case where two ink droplets are discharged to the pixel at the writing start position.

The number of ink droplets may have to be reduced when no ink is discharged to a certain number of successive pixels in the range of about several hundred to several thousand pixels, correspond to about 0.1 to 1 second during which no ink is discharged, although the number is different depending upon temperature, humidity, ink composition and the like.

In general, since an increase in the amount of a volatile component contained in the ink increases the evaporating speed of the volatile component, and increases the density of the color material in the ink more quickly, it is preferable to shorten the time when no ink is discharged (also referred to as a non-discharging time) of the recording head and to reduce the number of pixels to which no ink was discharged. In addition, since a high temperature printing environment also increases the evaporating speed of the volatile component, it is preferable to shorten the non-discharging time. In addition, when the volatile component is water, lower relative humidity increases the evaporating speed of the water, and it is preferable to shorten the non-discharging time in environments having low relative humidity.

Further, when the lower (thinner) density of the color material in the ink makes the change of the color density caused by the evaporation of the volatile component noticeable, it is preferable to shorten the non-discharging time and to reduce the number of pixels to which no ink is discharged.

The first embodiment is arranged such that a non-discharging time or a number of pixels which affect the density of an image caused by an increase in color material density is previously determined to be a specific time or number of pixels, and recording data is examined for every one line. When the time or number of pixels to which no ink is discharged exceeds the specific time or number of pixels, the number of ink droplets for forming one pixel is reduced. More specifically, in an apparatus in which one speed is set for the carriage and one density is set for the pixels, the specific number of pixels which serve as a reference is determined from the carriage speed and the number of pixels based on the specific period of time during which non-discharging of ink adversely affects the image density due to an increase in color material density. On the other hand, in an apparatus in which a plurality of carriage speeds and one density are set for the pixels, the specific numbers of pixels which serve as a reference are determined according to the respective carriage speeds in accordance with the above specific period of time. Then, discharge data for one scan is examined and when non-discharging of ink corresponding to the specific number of pixels continues for each discharge port, the number of ink droplets discharged for the first time after resuming ink discharge is reduced.

The specific number of pixels may be set by the user based on temperature for example, every time recording is carried out, or may be automatically set by assembling a temperature sensor and/or a humidity sensor and assuming an increase in color material, density in the vicinity of a discharge port from the values detected by the sensors.

Although the first embodiment describes an example wherein the number of ink droplets is reduced at only the first pixel at the writing start position, the number of ink droplets may be reduced over a plurality of pixels at the writing start position when the density of the recorded color noticeably increases.

Embodiment 2

A second embodiment of the present invention is directed to a situation in which four-level recording is carried out by forming one pixel 0 to 3 ink droplets.

In the second embodiment, when at least a specific number of pixels to which no ink is discharged are successively located, the number of ink droplets discharged to a pixel at the writing start position is reduced from an ordinary number. The number of ink droplets to be discharged is determined according to the following table.

TABLE 1

| Image Density | Number of Ink Droplets Ordinarily Discharged | Number of Ink Droplets Discharged to Writing Start Position |
|---|---|---|
| High | 3 | 2 |
| Medium | 2 | 1 |
| Low | 1 | ½ |

When the number of ink droplets to be discharged to the writing start position is shown in the table to be 1/2, two pixels in an auxiliary scanning direction are located at the writing start position and one ink droplet is to be discharged from two successive discharge ports. The number of ink droplets to be discharged to one of the two pixels is then set to 0. When the number of ink droplets discharged to any one of the two pixels is 1, a single ink droplet is discharged. Thus, in the above processing for setting the number of ink droplets to be discharged to 1/2, one ink droplet is discharged to a pixel located next to a pixel to which no ink droplet was discharged.

Embodiment 3

When one pixel is formed of a maximum of 4 dot drops, a third embodiment of the present invention includes two types of algorithms for converting the density corresponding to image data obtained during image processing into the number of ink droplets to be discharged. With this arrangement, the number of ink droplets to be discharged to a pixel at the writing start position, as a result of the image processing, may be made to be smaller than that of an ordinary pixel.

Figure 4:
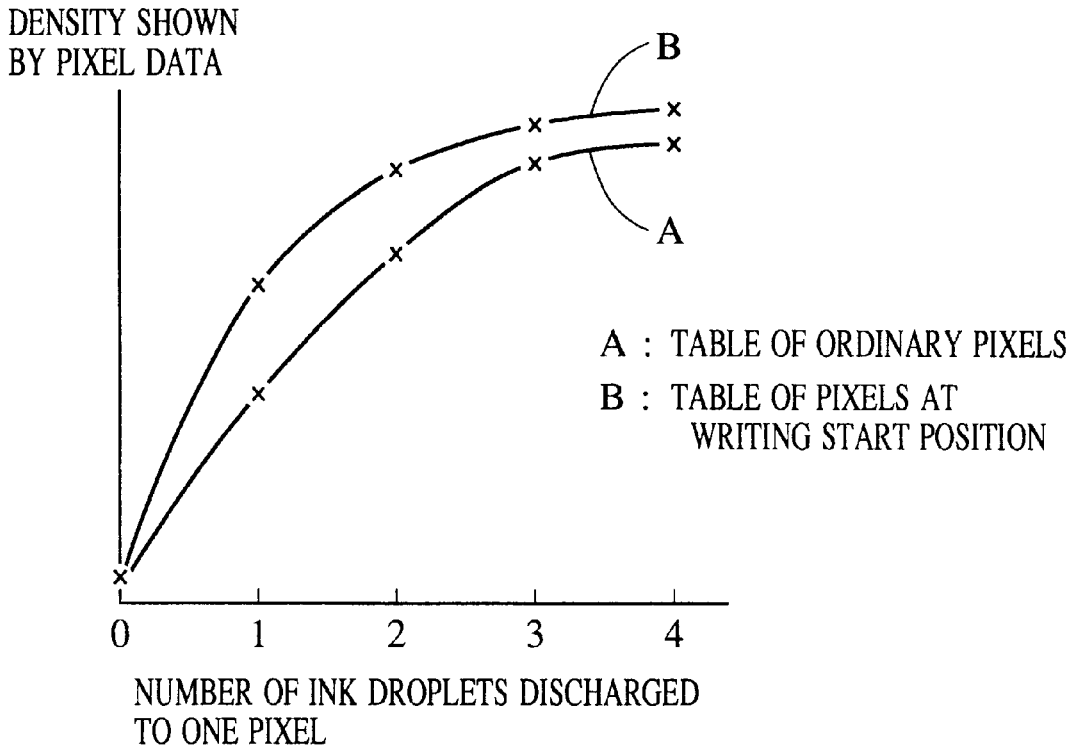
FIG. 4 illustrates graphs of two conversion tables used in the recording method according to a third embodiment of the present invention.

The third embodiment includes Tables A and B for converting the image density into a number of ink droplets to be discharged at the writing start position and a non-writing start position such ordinary pixels as shown in, for example, FIG. 4. Both Tables A and B may be used during the image processing. With this arrangement, since the threshold values of the densities corresponding to the respective numbers of ink droplets are set to a higher level in Table B for the writing start position, the number of ink droplets resulting from the image processing is smaller than that of ordinary pixels.

Also effective for reducing image density is a method for image processing after optical density data of the image writing start position is corrected to be at a recording level which is lower than a normal recording level by a certain amount.

Embodiment 4

The aforesaid first-third embodiments provide features such that when it is determined that a non-discharging time, or a number of non-discharge pixels to which no ink droplet is discharged, is greater than a specific value, the number of ink droplets to be discharged to a first pixel after the non-discharge time or non-discharge pixel is reduced. Whereas, a fourth embodiment reduces an amount of ink discharged in an ink droplet discharged to the above-mentioned first pixel.

Figure 5:
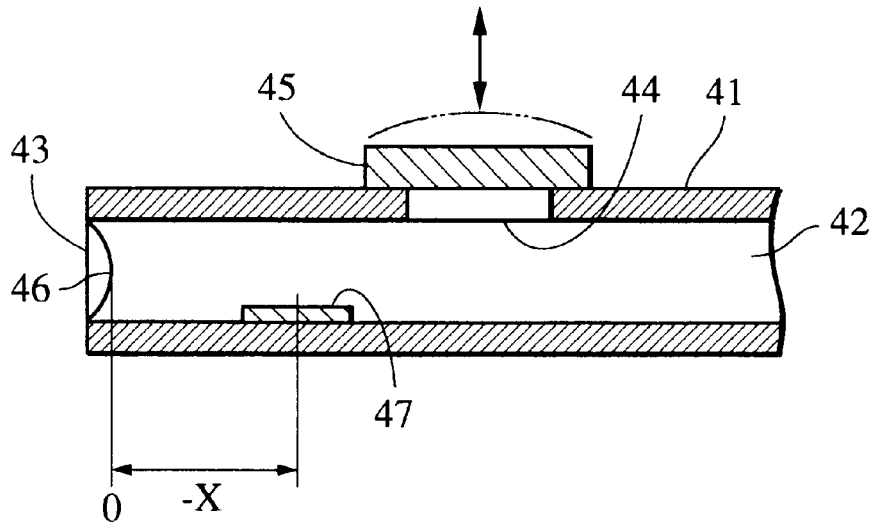
FIG. 5 is a sectional view showing the liquid passage structure of a recording head according to a fourth embodiment of the present invention.

FIG. 5 is a sectional view showing a mechanism for discharging ink from the recording head of the fourth embodiment.

Numeral 41 in FIG. 5 is a liquid passage which comprises a thin glass tube, for example, for receiving a liquid 42 such as ink, for example. An opening 44 is formed in the vicinity of orifice 43 of the liquid passage 41, and a piezoelectric element 45, shown as an example for controlling the meniscus is disposed close to the opening 44.

The piezoelectric element 45 may be deformed externally to a convex shape as shown by the two-dot-and-dash-line in FIG. 5 when a voltage is imposed thereon. The liquid 42 is then drawn away from the opening 44 toward the piezoelectric element 45, so that the position of a meniscus 46 is retracted inward.

When the voltage imposed on the piezoelectric element 45 is shut off, the piezoelectric element 45 returns to its original state and the position of the meniscus 46 returns to its original position.

A heating electrode 47 is disposed on an inner surface of the liquid passage 41 between the orifice 43 and the piezoelectric element 45.

When a pulse voltage is imposed on the heating electrode 47 in accordance with a print command, the liquid 42 in the vicinity of the orifice 43 is heated and abruptly expanded and is then discharged from the orifice 43 in the form of a liquid droplet composed of the liquid 42. A dot is then recorded by the liquid droplet.

In the above arrangement, the fourth embodiment employs a system for controlling the amount of liquid in a droplet by setting the amount of the liquid 42 located on the orifice 43 near the heating electrode 47 to a target amount. The liquid 42 is then discharged by imposing a voltage on the heating electrode 47.

Figures 6A, 6B, 6C:
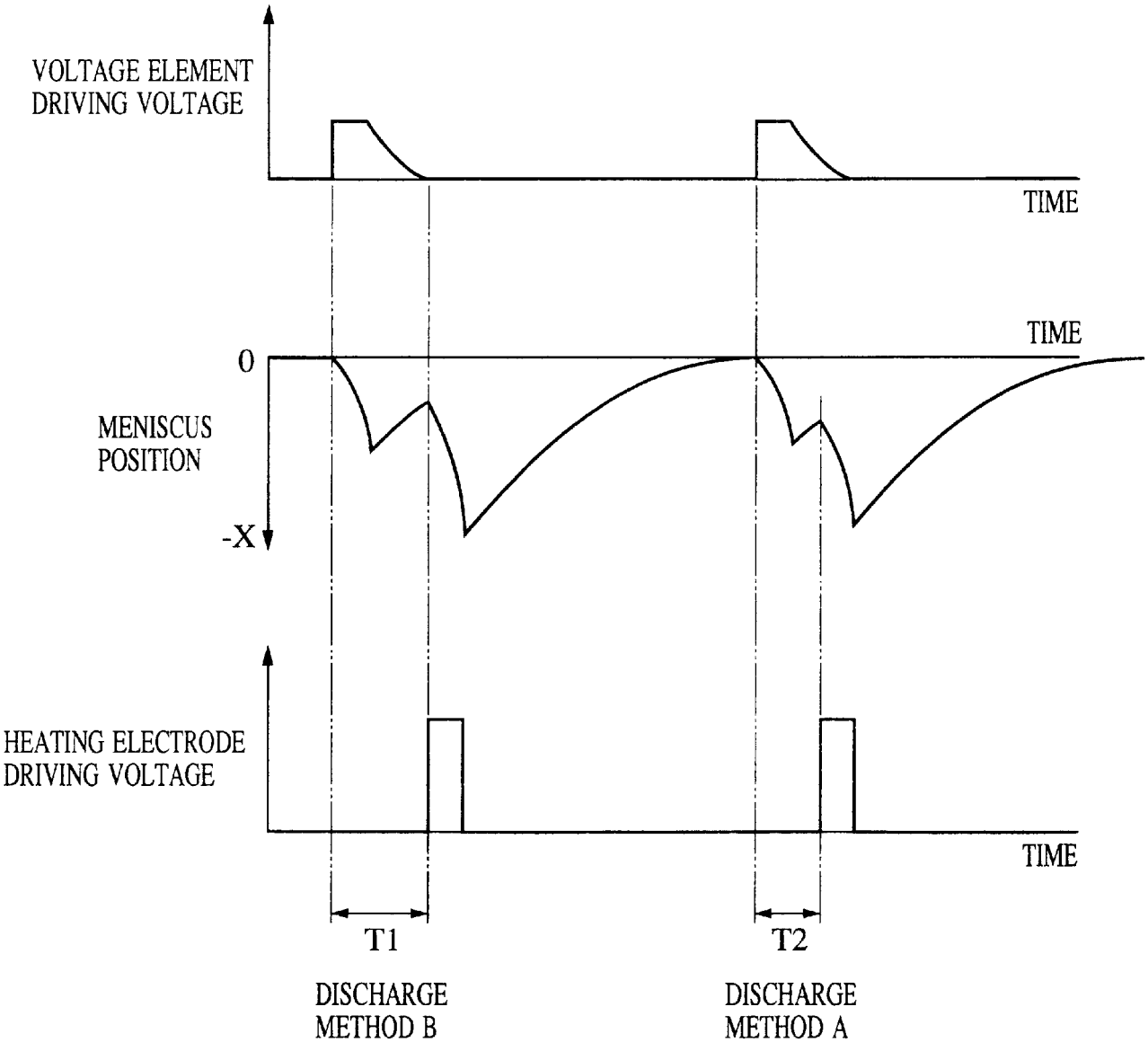
FIG. 6A, FIG. 6B and FIG. 6C show meniscus control in the recording head and a discharge amount control effected in accordance with the meniscus control accordance to the fourth embodiment of the present invention.

More specifically, the fourth embodiment controls the amount of liquid in the liquid droplet by setting the voltage imposed on the piezoelectric element 45 to a constant value as shown in FIG. 6A, and changing the time until the pulse voltage is imposed on the heating electrode 47.

A specific operation will be described below.

When the pulse voltage having a constant voltage value according to the print command is imposed on the piezoelectric element 45 as shown in FIG. 6A, the piezoelectric element 45 is deformed and expands externally. As a result, the meniscus 46 located substantially at the position of the orifice 43 is retracted.

When the position of the meniscus 46 at the initial position is shown by 0 and the distance of retraction of the meniscus 46 toward the heating electrode 47 is shown by -x, the meniscus 46 begins to retract simultaneously with the imposition of the voltage on the piezoelectric element 45 as shown in FIG. 6B. When the piezoelectric element 45 is deenergized, the miniscus begins to advance.

Therefore, the amount of the liquid 42 located *forward of the heating electrode 47 is changed in accordance with an elapse of time after the imposition of the voltage on the piezoelectric element 45.

More specifically, as shown in FIG. 6C, when the time after the voltage is imposed on the piezoelectric element 45 is shown by $T_1$, $T_2$, is set to $T_1>T_2$, and the constant voltage is imposed on the heating electrode 47, the liquid 42 can be discharged with a changed amount. The amount of liquid in a liquid droplet is thereby changed.

Figure 7A:
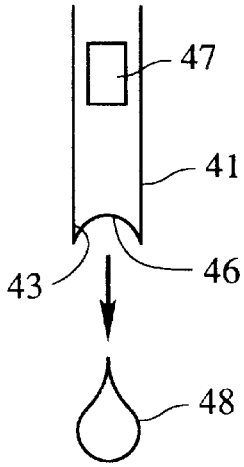
FIG. 7A and FIG. 7B are sectional views of an ink discharge port and show a meniscus position set by the meniscus control according to the fourth embodiment of the present invention.

When the voltage is imposed on the heating electrode 47 after the elapse of the long time $T_1$, after the voltage is imposed on the piezoelectric element 45, the meniscus 46 advances up to the vicinity of the orifice 43 as shown in FIG. 7A. The liquid 42 located forward of the heating electrode 47 is thereby discharged in a relatively large amount.

Figure 7B:
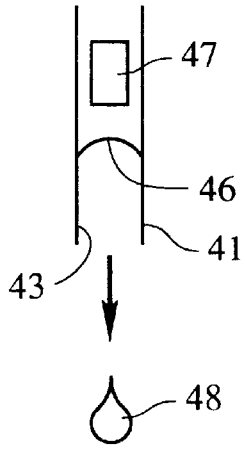

When the voltage is imposed on the heating electrode 47 after the elapse of the short time $T_2$ after the voltage is imposed on the piezoelectric element 45, the meniscus 46 advances a short distance as shown in FIG. 7B. A relatively small amount of the liquid 42 is then located forward of the heating electrode 47. Accordingly, the amount of the discharged liquid droplet 48 is relatively small and the diameter thereof is also relatively small.

As described above, a dot diameter can be changed by making the voltage imposed on the piezoelectric element constant and changing the time until the voltage is imposed on the heating electrode.

In the above arrangement, when the ink is discharged to a pixel at the writing start position by a discharge method B shown in FIGS. 6A–6C, and to the other pixels by a discharge method A shown in FIGS. 6A–6C, the amount of discharged ink is about 40% of the amount of ink discharged to the other, regularly recorded, pixels. As a result, an image whose density is the same for a pixel at the writing start position and for the other pixels is recorded.

Embodiment 5

A fifth embodiment reduces the amount of an ink droplet like the aforesaid fourth embodiment.

Figure 8:
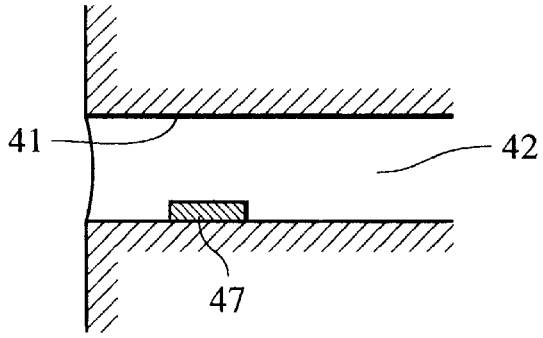
FIG. 8 is a sectional view showing the liquid passage structure of the recording head according to a fifth embodiment of the present invention.
Figure 9:
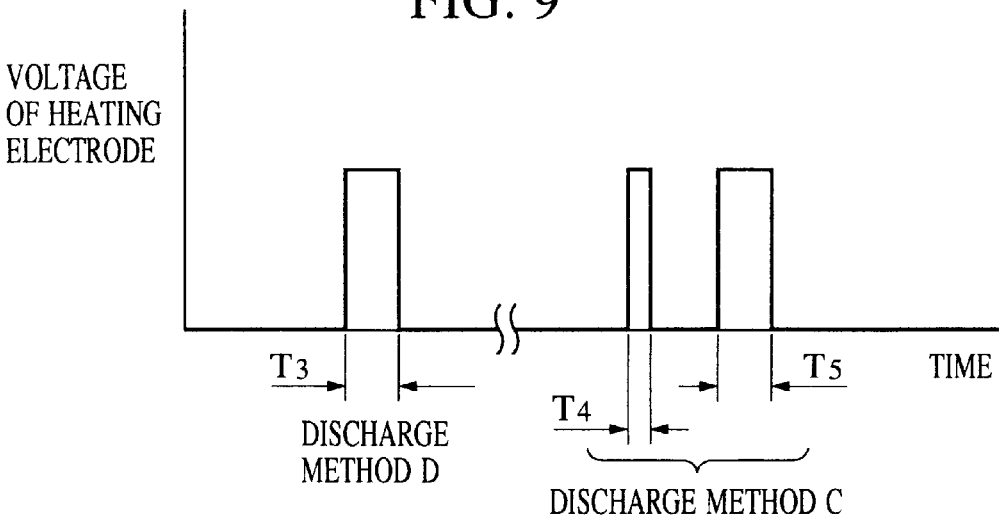
FIG. 9 is a view describing a head drive pulse used in the fifth embodiment of the present invention.

In a recording head having a liquid passage structure shown in FIG. 8, a heating electrode voltage as shown in FIG. 9 is imposed on the heating electrode 47. A pulse shown by a discharge method C in FIG. 9 is imposed to form ordinary pixels located at a portion other than at a writing start position. The pulse is composed of two pulses as shown in FIG. 9, and ink can be heated to a temperature at which it is not discharged by adjusting the pulse width $T_4$ of an initial pulse. Then, when the ink is discharged in response to a later pulse, the ejected amount can be made relatively large.

The ink is discharged to a pixel at the writing start position by imposing a single pulse as shown by a discharge method D in FIG. 9. With this operation, the discharge amount achieved by the discharge method D is made to be about 70% of that achieved by the discharge method C by the adjustment of a pulse width $T_3$, although the discharge amount in the discharge method D is generally smaller than that in the discharge method C. As a result, the fifth embodiment can suppress an increase of the image density at the writing start position, and can also obtain an image whose density is the same for the pixel at the writing start position and the other pixels.

Embodiment 6

In a sixth embodiment, a liquid passage is provided with two heating electrodes and the amount of ink in a discharged ink droplet is changed by changing the number of the heating electrodes that are driven to eject the ink.

Figure 10:
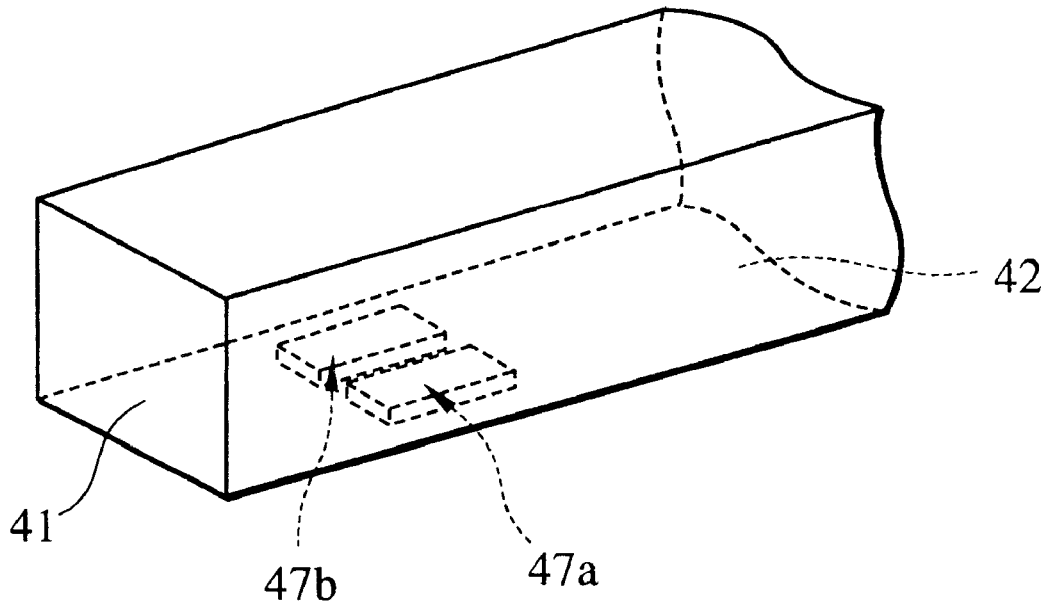
FIG. 10 is a perspective view showing the liquid passage structure of the recording head according to a sixth embodiment of the present invention.

FIG. 10 is a view showing the liquid passage structure of the recording head of the sixth embodiment, wherein the liquid passage 41 is provided with two heating electrodes 47*a*, 47*b*. With this arrangement, only the heating electrode 47*a* is driven to form a pixel at the recording start portion, whereas both the heating electrodes 47*a* and 47*b* are driven to form the other pixels. As a result, the amount of ink in an ink droplet when only the heating electrode 47*a* is driven is made to be about 60% of the amount of ink in an ink droplet when both the heating electrodes are driven.

In any one of the above fourth to sixth embodiments, when the ink is discharged by any arbitrary nozzle after about 0.2 second elapses from a previous discharge of the ink, or after the carriage moves a distance longer than about 2000 pixels (condition 1), the amount of the discharged ink is made to be about 80% or less of the amount of ink discharged under an ordinary discharge condition (condition 2: the ink is discharged within about 0.2 second after the previous discharge or before the carriage moves a distance less than about 2000 pixels). Accordingly, the problem where the image dots formed under the condition 1 appears denser than the image dots formed under the condition 2 can be prevented.

The present invention is particularly suitable for use in an ink jet recording head and recording apparatus using thermal energy generated by an electrothermal transducer, or using a laser beam, for example, to cause a change of state of the ink to eject or discharge the ink. This is because recording picture elements having a high density and a high resolution is possible.

The typical structure and the operational principle of such recording devices are preferably the ones disclosed in U.S. Pat. Nos. 4,723,129 and 4,740,796, for example. The principle and structure are applicable to a so-called on-demand type recording system and a continuous type recording system. Particularly, however the present invention, is suitable for the on-demand type recording device because such devices provide at least one driving signal to an electrothermal transducer disposed on a liquid (ink) retaining sheet or liquid passage. In such systems, the driving signal is sufficient to provide a quick temperature rise beyond a departure from a nucleation boiling point, and the resulting thermal energy produces film boiling near the heating portion of the recording head. In this manner, a bubble may be formed in the liquid ink corresponding to each of the driving signals. By the production, development and construction of the bubble, the liquid ink is ejected through an ejection outlet to produce at least one droplet. The driving signal is preferably in the form of a pulse, because the development and construction of the bubble can be effected instantaneously, and therefore, the liquid ink is ejected with a quick response to the pulse. The driving signal in the form of the pulse is preferably such as disclosed in U.S. Pat. Nos. 4,463,359 and 4,345,262, for example. In addition, the temperature increasing rate of the heating source is preferably such as disclosed in U.S. Pat. No. 4,313,124, for example.

The structure of the recording head may be as shown in U.S. Pat. Nos. 4,558,333 and 4,459,600, for example, wherein the heating portion is disposed at a bent portion in the recording head. An example of the structure of the combination of the ejection outlet, liquid passage and the electrothermal transducer is also disclosed in the above-mentioned patents. In addition, the present invention is applicable to the structure disclosed in Japanese Laid-Open Patent Application No. 123670/1984, wherein a common slit is used as the ejection outlet for plural electrothermal transducers, and to the structure disclosed in Japanese Laid-Open Patent Application No. 138461/1984, wherein an opening for absorbing pressure waves from the thermal energy is formed corresponding to the ejecting portion. The present invention is thus effective to perform a recording operation at a high efficiency regardless of the type of recording head.

In addition, the present invention may be applied to a serial type recording head wherein the recording head is fixed on a main recording assembly, to a replaceable chip type recording head which is connected electrically with the main recording apparatus and which can be supplied with ink when the recording head is mounted on the main recording assembly, or to a cartridge type recording head having an integral ink container.

The provisions of a recovery device and/or an auxiliary device for a preliminary ejecting operation are preferable, because they can further stabilize the recording effects of the present invention. Examples of such devices include a capping unit for the recording head, a cleaning unit therefor, a passing or a sucking device, a preliminary heating device which may be an electrothermal transducer, an additional heating electrode or a combination thereof. Also, a device for effecting preliminary ejection (not for the recording operation) can stabilize the recording operation.

As regards the vibration of the recording head, it may be a single recording head corresponding to a single color of ink, or it may be plural heads corresponding to the plurality of ink materials having different recording colors or densities. The present invention is effectively applied to a recording apparatus having at least one of a monochromatic recording mode for recording mainly with black ink, a multi-color recording mode with different color ink materials and/or a full-color recording mode using a mixture of colors. Such a recording apparatus may be an integrally formed recording unit or a combination of plural recording heads.

Furthermore, in the foregoing embodiments, the ink has been a liquid. The ink also may be a solid below room temperature but a liquid at room temperature. Since the ink is kept within a temperature range of between about 30° C. to about 70° C., in order to stabilize the viscosity of the ink to provide the stabilized ejection in the usual recording apparatus of this type, the ink may be liquid within this temperature range when the recording signal in the present invention is applied. Otherwise, the temperature rise due to the thermal energy is positively prevented by being consumed for a state change of the ink from the solid state to the liquid state. Another ink material may be solidified when it is not in use to prevent the evaporation of the ink. In either of the above discussed cases, the ink is liquefied in response to the application of the recording signal producing thermal energy, and the liquefied ink may be ejected. Another type of ink material may start to be solidified at the time when it reaches the recording material.

The present invention is also applicable to such an ink material as is liquefied by the application of thermal energy. Such an ink material may be retained as a liquid or a solid material in continuous holes or recesses formed in a porous sheet, as disclosed in Japanese Laid-Open Patent Application No. 56847/1979, and in Japanese Laid-Open Patent Application No. 71260/1985, for example. The sheet is then faced toward electrothermal transducers. The most effective one of the techniques described above is the film boiling system.

The above-described ink jet recording apparatus may be used, for example, as an output terminal of an information processing apparatus such as a computer, as a copying apparatus combined with an image reader, or as a facsimile machine having information sending and receiving functions.

The individual components shown in outline or designated by blocks in the drawings are all well-known in the ink jet recording art, and their specific construction and operation are not critical to the operation or best mode for carrying out the invention.

While the present invention has been described with respect to what is at present considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as encompass all such modifications and equivalent structures and functions.

According to the present invention, when non-discharge data exists in recording data corresponding to at least a specific number of successive pixels, or ink is not continuously discharged for at least a specific period of time in a pixel train formed by ink droplets discharged from one ink discharge port, the amount of ink discharged to a pixel in response to at least the first discharge data supplied thereafter is reduced. The amount of ink is reduced when the ink in which the density of a color material is increased during the non-discharge period, and an increase of the density of the pixel caused by it can be suppressed.

What is claimed is:

1. An ink jet recording apparatus for performing recording by discharging ink onto a recording medium in accordance with recording data using a recording head having ink discharge ports for discharging the ink, said apparatus comprising:

scanning means for scanning the recording head relative to the recording medium for discharging ink to record pixels on the recording medium;

determining means for determining whether the recording data includes non-discharge data for a predetermined number of successive pixels to be recorded by the recording head, and for generating a corresponding determination output signal; and control means for reducing ink discharge in accordance with the determination output signal such that an amount of ink discharged for forming at least one pixel subsequent to the predetermined number of successive pixels is reduced from a predetermined recording amount when the recording data is determined to include non-discharge data for the predetermined number of successive pixels.

2. An ink jet recording apparatus according to claim 1, wherein said determining means further sets the predetermined number of successive pixels in accordance with at least one of a scanning speed of the recording head, a density of the pixels, and a predetermined period of a time during which non-discharge of ink from the ink discharge ports affects a concentration of color material in the ink.

3. An ink jet recording apparatus according to claim 1, wherein said control means controls the ink discharge to reduce an amount of ink for forming the at least one pixel by reducing a number of ink discharges.

4. An ink jet recording apparatus according to claim 3, wherein said control means controls the number of ink discharges to form respective pixels by performing one of (i) setting a density value used for obtaining the number of ink discharges to high level for the at least one pixel, and (ii) reducing a number of ink discharge corresponding to a value of image data by a predetermined ratio when determining a number of ink discharges for recording the at least one pixel.

5. An ink jet recording apparatus according to claim 1, wherein the at least one pixel is recorded immediately after a non-recording period corresponding to the non-discharge data.

6. An ink jet recording apparatus according to claim 1, wherein said control means controls the ink discharge by reducing a volume of ink discharged during each discharge of ink.

7. An ink jet recording apparatus according to claim 6, wherein said control means controls the ink discharge by controlling a meniscus of the ink at the discharge ports.

8. An ink jet recording apparatus according to claim 6, wherein said control means controls the ink discharge by controlling energy employed to discharge the ink.

9. An ink jet recording apparatus according to claim 6, wherein said control means controls the ink discharge by controlling a number of heat generating elements which are driven to discharge the ink.

10. An ink jet recording apparatus according to claim 6, wherein said control means controls the ink discharge by reducing an amount of ink to be discharged to about 80% of the predetermined recording amount.

11. An ink jet recording apparatus according to claim 1, wherein said determining means sets the predetermined number to be in a range from several hundred to several thousand pixels.

12. An ink jet recording apparatus according to claim 1, wherein the recording head includes a thermal energy generator for generating thermal energy for discharging the ink.

13. an ink jet recording apparatus for performing recording by discharging ink onto a recording medium in accordance with recording data using a recording head having ink discharge ports for discharging the ink, said apparatus comprising:

scanning means for scanning the recording head relative to the recording medium for discharging ink to record pixels;

determining means for determining whether the ink is not discharged for a predetermined period of time, in a non-recording period, in accordance with the recording data, and for generating a corresponding determination output signal; and control means for reducing ink discharge in accordance with the determination output signal such that an amount of ink discharged during a discharge period to record at least one pixel, subsequent to the nonrecording period, is reduced from a predetermined recording amount when said determining means determines that the ink is not discharged for the predetermined period of time during the non-recording period.

14. An ink jet recording apparatus according to claim 13, wherein said determining means further sets the predetermined period of time in accordance with at least one of a scanning speed of the recording head, a density of the pixels, and a time period during which the non-discharge of ink from the ink discharge ports affects a density of color material of the ink.

15. An ink jet recording apparatus according to claim 13, wherein said control means controls the ink discharge to reduce the amount of ink for forming the at least one pixel by reducing a number of ink discharges.

16. An ink jet recording apparatus according to claim 15, wherein said control means controls the number of ink discharges to form respective pixels by performing one of (i) setting a density value for obtaining the number of ink discharge to a high level for the at least one pixel, and (ii) reducing a number of ink discharges corresponding to a value of image data by a predetermined ratio when determining a number of ink discharges for recording the at least one pixel.

17. An ink jet recording apparatus according to claim 13, wherein the at least one pixel is recorded immediately after the non-recording period.

18. An ink jet recording apparatus according to claim 13, wherein said control means controls the ink discharge by reducing a volume of ink discharged during each discharge of ink.

19. An ink jet recording apparatus according to claim 18, wherein said control means controls the ink discharge by controlling a meniscus of the ink at the discharge ports.

20. An ink jet recording apparatus according to claim 18, wherein said control means controls the ink discharge by controlling energy employed to discharge the ink.

21. An ink jet recording apparatus according to claim 18, wherein said control means controls the ink discharge by controlling a number of heat generating elements which are driven to discharge the ink.

22. An ink jet recording apparatus according to claim 18, wherein said control means controls the ink discharge by reducing an amount of ink to be discharged to about 80% of a predetermined recording amount.

23. An ink jet recording apparatus according to claim 13, wherein said determining means sets the predetermined period of time to be about 0.2 second.

24. An ink jet recording apparatus according to claim 13, wherein the recording head includes a thermal energy generator for generating thermal energy for discharging the ink.

25. An ink jet recording apparatus for performing recording by discharging ink onto a recording medium in accordance with recording data using a recording head having ink discharge ports for discharging the ink, said apparatus comprising:

scanning means for scanning the recording head relative to the recording medium for discharging ink to record pixels;

determining means for determining when a nondischarge section of recording data, corresponding to a predetermined time period, changes to a discharge section of recording data, and for generating a corresponding determination output signal; and control means for reducing recording in accordance with the determination output signal such that an amount of ink discharged to record at least one pixel, when the non-discharge section is determined to change to the discharge section, is reduced from a predetermined recording amount.

26. An ink jet recording apparatus according to claim 25, wherein said determining means further sets the predetermined time period in accordance with at least one of a scanning speed of the recording head, a density of the pixels, and a period of time during which non-discharge of ink from the ink discharge ports affects a concentration of color material in the ink.

27. An ink jet recording apparatus according to claim 25, wherein said control means controls the ink discharge to reduce an amount of ink for forming the at least one pixel by reducing a number of ink discharges.

28. An ink jet recording apparatus according to claim 27, wherein said control means controls the number of ink discharges to form respective pixels by performing one of (i) setting a density value used for obtaining the number of ink discharges to a high level for the at least one pixel, and (ii) reducing a number of ink discharges corresponding to a value of image data by a predetermined ratio when determining a number of ink discharges for recording the at least one pixel.

29. An ink jet recording apparatus according to claim 25, wherein the at least one pixel is recorded immediately after the non-discharge section of recording data.

30. An ink jet recording apparatus according to claim 25, wherein said control means controls the ink discharge by reducing a volume of ink discharged during each discharge of ink.

31. An ink jet recording apparatus according to claim 30, wherein said control means controls the ink discharge by controlling a meniscus of the ink at the discharge ports.

32. An ink jet recording apparatus according to claim 30, wherein said control means controls the ink discharge by reducing the amount of ink to be discharged to about 80% of the predetermined recording amount.

33. An ink jet recording apparatus according to claim 25, wherein said determining means sets the predetermined time period to correspond to a range from several hundred to several thousand pixels.

34. An ink jet recording method for performing recording by discharging ink onto a recording medium in accordance with recording data using a recording head having ink discharge ports for discharging the ink, said method comprising the steps of:

scanning the recording head relative to the recording medium for discharging ink to record pixels on the recording medium;

determining whether the recording data includes nondischarge data for a predetermined number of successive pixels to be recorded by said recording head, and generating a corresponding determination output signal; and controlling ink discharge in accordance with the determination output signal to reduce from a predetermined recording amount an amount of ink discharged for forming at least one pixel subsequent to the predetermined number of successive pixels when the recording data is determined to include non-discharge data for the predetermined number of successive pixels.

35. An ink jet recording method for performing recording by discharging ink onto a recording medium in accordance with recording data using a recording head having ink discharge ports for discharging the ink, said method comprising the steps of:

scanning the recording head relative to the recording medium for discharging ink to record pixels;

determining whether the ink is not discharged for a predetermined period of time, in a non-recording period, in accordance with the recording data, and generating a corresponding determination output signal; and controlling ink discharge in accordance with the determination output signal to reduce from a predetermined recording amount an amount of ink discharged during a discharge period to record at least one pixel, subsequent to the non-recording period, when the ink is determined not to be discharged during the non-recording period.

36. An ink jet recording method for performing recording by discharging ink onto a recording medium in accordance with recording data using a recording head having ink discharge ports for discharging the ink, said method comprising the steps of:

scanning the recording head relative to the recording medium and discharging ink to record pixels;

determining when a non-discharge section of recording data, corresponding to a predetermined time period, changes to a discharge section of recording data, and generating a corresponding determination output signal; and controlling recording in accordance with the determination output signal to reduce from a predetermined recording amount an amount of ink discharged to record at least one pixel, when the non-discharge section is determined to change to the discharge section.

37. An ink jet recording apparatus according to claim 11, wherein said determining means sets the predetermined number to be about 2000.

38. An ink jet recording apparatus for making recording by discharging ink onto a recording medium using a recording head for discharging the ink, comprising:

scanning means for causing the recording head to relatively scan the recording medium;

discrimination means for discriminating whether at least a specific number of pixels having non-discharge data successively exist or not based on the discharge data of pixels which are formed in correspondence to the ink discharge ports of the recording head in the scanning effected by said scanning means; and processing means for executing ink reduction, when said discrimination means discriminates that at least the specific number of successive pixels having non-discharge data successively exist, for reducing an amount of ink for forming at least a pixel with a first discharge data which is located successively to the successive pixels.

39. An ink jet recording apparatus for making recording by discharging ink onto a recording medium using a recording head for discharging the ink, comprising:

scanning means for causing the recording head to relatively scan the recording medium;

discrimination means for discriminating whether the ink is not discharged to the ink discharge ports of the recording head for at least a specific period of time or not based on discharge data of a pixel which is to be formed in correspondence to the ink discharge ports in the scanning effected by said scanning means; and processing means for executing ink reduction, when said discrimination means discriminates that the ink is not discharged for at least the specific period of time, for reducing an amount of ink for forming a pixel which is formed by a first discharge of the ink after the non-discharge period.

40. An ink jet recording method of making recording by discharging ink onto a recording medium using a recording head for discharging the ink, comprising the steps of:

scanning the recording head relatively to a recording medium; and reducing an amount of ink discharged to a portion which changes from a non-discharge section, which continues for at least a specific period of time, to a discharge section as compared with an amount of ink discharged to other discharge sections.

41. An ink jet recording apparatus according to claim 1, wherein said determining means determines and generates to each of the ink discharge ports and said control means controls to each of the ink discharge ports.

42. An ink jet recording apparatus according to claim 13, wherein said determining means determines and generates for each of the ink discharge ports and said control means controls each of the ink discharge ports.

43. An ink jet recording apparatus according to claim 25, wherein said determining means determines and generates for each of the ink discharge ports and said control means controls each of the ink discharge ports.

44. An ink jet recording apparatus according to claim 34, wherein said determining step determines and generates to each of the ink discharge ports and said control step controls to each of the ink discharge ports.

45. An ink jet recording apparatus according to claim 35, wherein said determining step determines and generates to each of the ink discharge ports and said control step controls to each of the ink discharge ports.

46. An ink jet recording apparatus according to claim 36, wherein said determining step determines and generates to each of the ink discharge ports and said control step controls to each of the ink discharge ports.

* * * * *

UNITED STATES PATENT AND TRADEMARK OFFICE

CERTIFICATE OF CORRECTION

PATENT NO. : 6,102,511
DATED : August 15, 2000
INVENTOR(S) : Makoto Shioya et al.

It is certified that error appears in the above-identified patent and that said Letters Patent is hereby corrected as shown below:

Column 1,
Line 44, "to" should read -- on --.

Column 3,
Line 59, "accordance" (second occurrence) should read -- according --.

Column 4,
Line 7, "EMBODIMENT" should read -- EMBODIMENTS --; and
Line 36, "according" should read -- accordance --.

Column 5,
Lines 3 and 6, "12B*k*" should read -- 12B*k*), --;
Line 12, "drive" should read -- driver --; and
Line 31, "C.I" should read -- C.I. --; and "are" should reasd -- is --.

Column 6,
Line 4, "correspond" should read -- corresponding --;
Line 13, "of" should read -- from --;
Line 56, "material," should read -- material --; and
Line 67, "pixel 0 to 3" should read -- pixel from 0 to 3 --.

Column 7,
Line 40, "position such" should read -- position, such --.

Column 8,
Line 1, "ink, for example." should read -- ink. --; and
Line 49, "*forward" should read -- forward --.

Column 10,
Line 2, "appears" should read -- appear --; and
Line 17, "however" should read -- however, --; and "invention," should read -- invention --.

Column 11,
Line 63, "as encompass" should read -- as to encompass --.

Column 12,
Line 47, "discharge" should read -- discharges --.

UNITED STATES PATENT AND TRADEMARK OFFICE

CERTIFICATE OF CORRECTION

PATENT NO. : 6,102,511
DATED : August 15, 2000
INVENTOR(S) : Makoto Shioya et al.

It is certified that error appears in the above-identified patent and that said Letters Patent is hereby corrected as shown below:

Column 13,
Line 12, "an" should read -- An --; and
Line 48, "discharge" should read -- discharges --.

Column 16,
Lines 43, 55, 59, and 63, "to" should read -- for --; and
Lines 45, 57, 61, and 65, "to" should be deleted.

Signed and Sealed this

Twenty-ninth Day of January, 2002

*Attest:*

*Attesting Officer*

JAMES E. ROGAN
*Director of the United States Patent and Trademark Office*